United States Patent [19]

Herscovitz

[11] 4,143,255

[45] Mar. 6, 1979

[54] DEVICE FOR DETECTING FLUID FLOW

[76] Inventor: Jack Herscovitz, 544 W. 182nd St., Gardena, Calif. 90248

[21] Appl. No.: 834,278

[22] Filed: Sep. 19, 1977

[51] Int. Cl.[2] ..... H01H 35/40

[52] U.S. Cl. ..... 200/81.9 M; 340/610; 73/228

[58] Field of Search ..... 91/1; 340/239 R, 240, 340/606, 610; 73/228, 186; 200/81.9 R, 81.9 M

[56] References Cited

U.S. PATENT DOCUMENTS

| | | | |
|---|---|---|---|
| 2,600,309 | 6/1952 | MacDonald | 200/81.9 M |
| 3,185,128 | 5/1965 | Moore | 73/228 |
| 3,354,716 | 11/1967 | Wiebe | 73/228 |
| 3,360,621 | 12/1967 | Liddell | 200/81.9 M |
| 3,387,489 | 6/1968 | Young | 340/239 R |
| 3,559,197 | 1/1971 | Jarvis | 200/81.9 M |

FOREIGN PATENT DOCUMENTS

| | | | |
|---|---|---|---|
| 741484 | 12/1955 | United Kingdom | 200/81.9 M |
| 1167180 | 10/1969 | United Kingdom | 200/81.9 M |

*Primary Examiner*—Gerald P. Tolin
*Attorney, Agent, or Firm*—Poms, Smith, Lande & Glenny

[57] ABSTRACT

A tubular section is provided through which fluid can flow. A paddle is mounted in the tubular section and is biased by a spring to a "no-flow" position, at least partially across the tubular section. Fluid flowing through the tubular section rotates the paddle to a "flow" position which is aligned and not across the tubular section. The device has been improved by having a signaling means in the form of a magnet mounted on the paddle in the tubular section for signaling when the paddle is in one of its positions. A switch mounted adjacent the tubular section receives the signal from the magnet and activates an indicator when it receives the signal so that the indicator indicates the position of the paddle. The paddle covers approximately one half of the cross section of the tubular section when the paddle is in the no-flow position. A baffle may be provided adjacent the paddle to direct flow to the portion of the tubular section through which the paddle moves. The paddle may pivot in part on a bushing in the lower part of the tubular section, and a relief in the tubular section intersects the bushing to relieve the vacuum caused by water flowing over the bushing. The vacuum, if not relieved by the slot, would pull the portion of the pivot in the bushing deeper therein thereby locking the paddle.

17 Claims, 6 Drawing Figures

DEVICE FOR DETECTING FLUID FLOW

BACKGROUND OF THE INVENTION

Numerous devices have been constructed for monitoring fluid flow through pipes. In some applications, it is very crucial to known when fluid is flowing. One such application involves marine cooling systems.

Many boat engines rely for cooling on the water supporting the boat. Normally water is driven from outside the boat through tubing to a heat exchanger where the engine heat is transferred to the cooling water, and the water is pumped out of the boat.

This can be a very efficient way for cooling a marine engine, but there are drawbacks. Cooling pumps can malfunction and debris in rivers, lakes and the ocean may be sucked into the cooling system and block the flow of cooling water to the engine. If this happens, there is a danger that the engine will overheat quickly and be damaged. Therefore, it is crucial to know immediately when fluid stops in a marine cooling system.

Obviously, there are many other applications in which it is important to detect whether fluid is flowing. The present invention has applications in the other technologies even though it was primarily designed for marine engine cooling systems.

If there is a blockage in the cooling system, there will be a change in pressure. A pressure gauge could be used to monitor such changes but there are some drawbacks with pressure gauges. First, many have numerous moving parts, and they can be delicate so that the debris which would clog the cooling pipes might also jam the pressure switch. Moreover, a pressure gauge may read increased or decreased pressure during a tube blockage depending on the location of the gauge relative to the block.

Flow detectors, sensitive to the flow of fluid through the system, could also be employed in lieu of pressure detectors. Many exist in the prior art. One conventional system uses a paddle in the path of fluid flow. The paddle is biased so that it is normally across the path of fluid flow. However, once flow starts, the paddle either aligns itself parallel to the fluid flow or moves against the wall of the fitting.

In certain conventional systems, the paddle is mounted on a shaft which extends through the tubing. The extension of the shaft is connected to a switch which detects whether the paddle is across the normal flow of fluid (the "no-flow" position) or parallel to the fluid flow (the flow position). For example, see Liddell, U.S. Pat. No. 3,360,621.

One major problem with prior art fluid flow devices was that the shaft mounting the paddle extended through the tubing walls. Seals were necessary in order to prevent fluid from leaking from the tubing past the shaft. This is especially true for oceangoing vessels because salt water can be extremely corrosive. Therefore, one of the objects of the present invention is to disclose and provide a flow sensor which does not rely on connections through the tubing walls to work.

Mounting the switch in the tubing with wires projecting through the tubing wall to the indicator apparatus creates two problems. Wires extending through the housing walls subjects the housing to leaks. Moreover, salt water and even fresh water can rapidly corrode a switch, especially because there will most likely be parasitic currents which can speed the corrosion of the switch. Therefore, an object of the present invention is to disclose and provide a switch mounted outside of the fluid flow which is sensitive to the orientation of the paddle with no connection from the paddle to the switch through the tubing walls.

Further objects of the present invention include disclosing and providing a flow detector in which the switch is mounted outside of the fluid carrier, the means for detecting fluid flow is in the carrier and there is no physical connection between them.

Other problems in the prior art exist. The paddle may have to distinguish between low flow and no flow. If a standard sized flow detector is to be connected to tubing of different diameter, the flow through the detector will be slower than the flow through small diameter tubing. Low flow may fail to pivot the paddle. Therefore, another object of the present invention is to disclose and provide a means for adjusting the cross-section through the tubular section at the paddle to direct the fluid to the side of the tubular section adjacent the paddle to speed fluid flow by the paddle.

Very fast fluid flow can create difficulties. If the paddle has a pivot point mounted in a bushing in the tubular section, fluid passing the bushing creates a vacuum in the indentation tending to pull the pivot on the paddle into the indentation. This cam jam the paddle in the flow position such that if flow stops, the paddle will not return to the no-flow position rendering the device ineffective at detecting flow stoppages. Therefore, another object of the present invention is to disclose and provide means for relieving the vacuum in the indentation so that the paddle will not jam in the flow position.

Other objects of the present invention include disclosing and providing a reliable system highly sensitive to low fluid flow. In that regard, a further object is to disclose and provide a system where corrosion is eliminated as much as possible. These and other objects will become evident in the following description of the invention.

Figure 3:
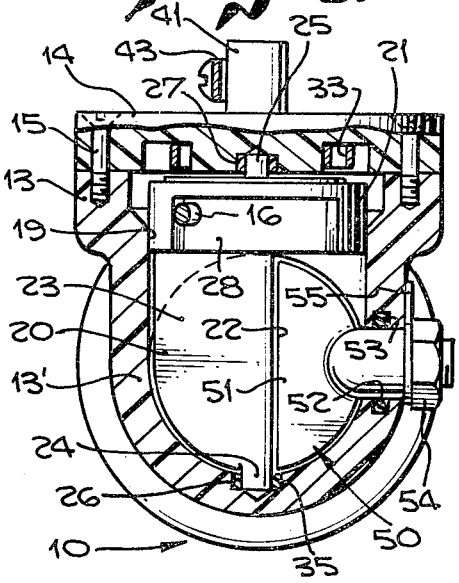

The sectional view of FIG. 3 is taken through the plane III—III and shows the paddle in the no-flow position.

Figure 4:
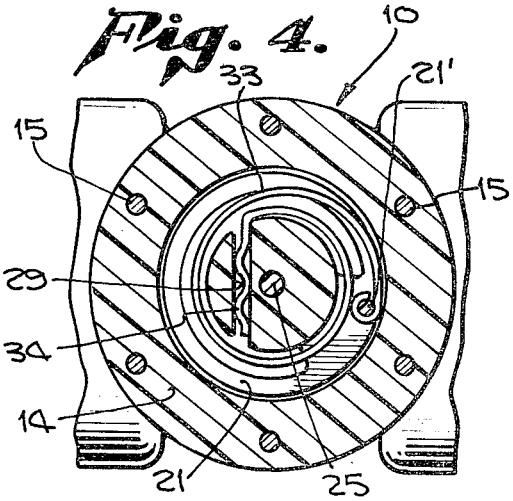

FIG. 4 is a top view, partially in section, showing the detail of the paddle head and the spring biasing it.

Figure 5:
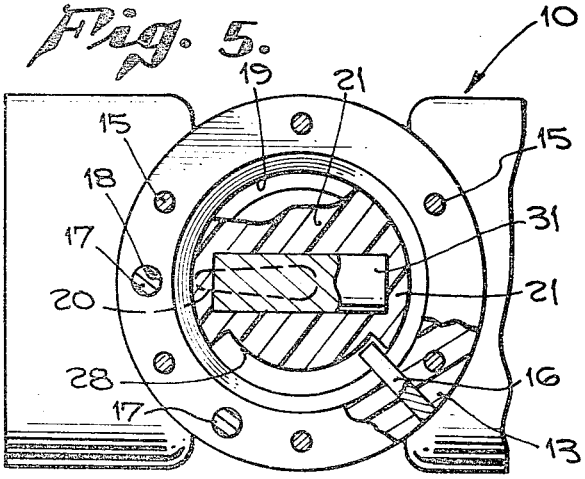

FIG. 5 is a top sectional view which is taken through the plane of the head of the paddle.

Figure 6:
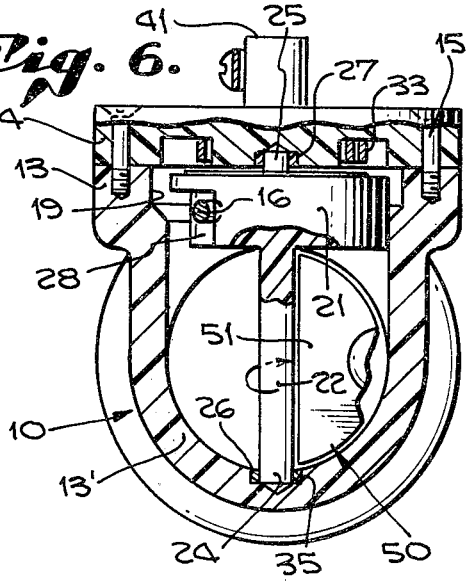

The paddle is turned on the flow position in FIG. 6, 90° from its position in FIG. 3.

DETAILED DESCRIPTION OF THE PREFERRED EMBODIMENT

The device of the present invention includes a tubular section 10 through which fluid can flow. Although there are many choices for materials for the device, the three factors that must be weighed are resistance to corrosion, resistance to heat deformation and costs. In the exemplary embodiment, CPVC, a relatively hard plastic, has been chosen. It is resistant to heat. It is much less expensive than corrosion resistant metals such as brass. However, if operating conditions demanded it, brass could be used. For reasons set forth hereinafter, the material must be nonmagnetic. The ends 11 and 12 of the tubular section 10 are threaded for connection to other tubing for inlet and outlet of the fluid.

Figure 1:
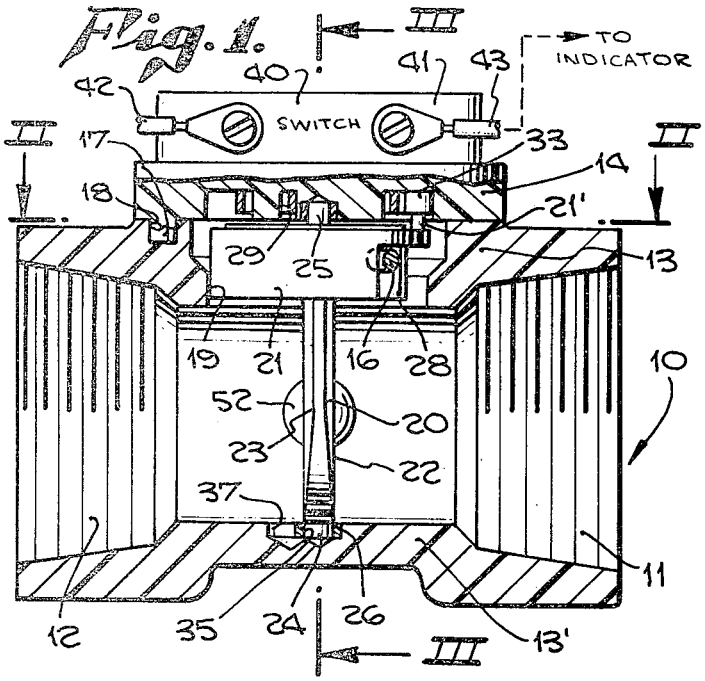
FIG. 1 is a sectional side view of the flow detector of the present invention.
Figure 2:
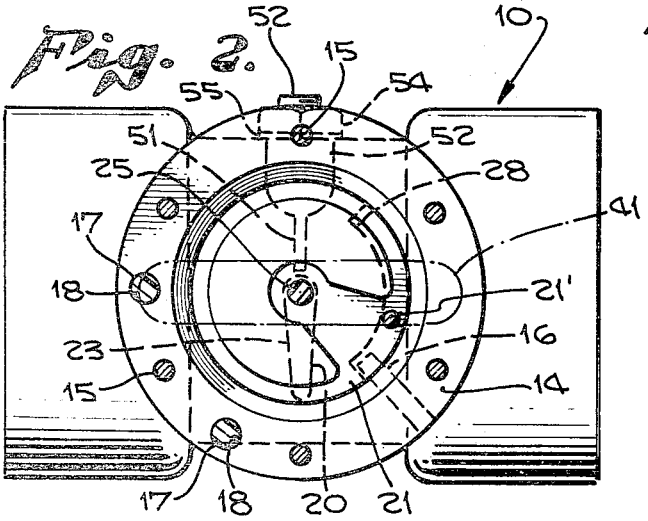
FIG. 2 is a top view of the flow detector of the present invention, partially in section, taken through plane II—II in FIG. 1.

Paddle means 20 is mounted in tubular section 10 for being moved to a flow position (FIGS. 5 and 6) by fluid flowing through the tubular section. Biasing means, which is discussed in more more detail hereinafter, biases the paddle to a no-flow position (FIGS. 1, 2 and 3).

As shown in FIG. 3, the tubular section is of generally circular cross section except for the cylindrical housing 13 which extends perpendicular to the tubular section and opens to the outside through opening 19.

The paddle includes a head at the top of the paddle, an axle depending from the head and a face on one side of the axle. The paddle is formed of Fiberite Epoxy in the preferred embodiment. Turning to the exemplary embodiment, especially FIG. 3, the head 21 of the paddle is mounted in cylindrical housing 13 for rotation therein. Axle portion 22 depends from the head, and face 23 extends from axle 22. Face 23 is generally shaped so that it conforms to wall 13' of tubular section 10 and to the wall 19 of the cylindrical housing. Some clearance is provided so that the face does not jam against the walls.

The biasing means normally urges the paddle to the no-flow position of FIG. 3. However, flow causes the paddle to assume an orientation with the least area in the path of the flow. That is, the face of the paddle assumes an orientation parallel to the fluid flow, the FIGS. 5 and 6 orientation.

Signaling means in the tubular section signals when the paddle is in one of its positions and a switch mounted adjacent the tubular housing receives the signal from the signaling means and activates an indicator when it receives a signal whereby the indicator indicates the position of the paddle. One of the important features of the present invention and part of the improvement herein is the provision of having the signaling means in the tubular section and the switch outside of the tubular section. In the exemplary embodiment, the signaling means comprises a magnet 31 mounted in the paddle means, and in the preferred exemplary embodiment, magnet 31 is mounted in head 21 (FIG. 5).

Switch means 40 (FIG. 1) is mounted adjacent the tubular section 10 for receiving a signal from the signaling means and for actuating an indicator when it receives a signal whereby the indicator indicates the position of the paddle means. In the exemplary embodiment, switch means, which is shown in schematic only at 40, is mounted in switch housing 41. Switch housing 41 is fastened by means of screws (not shown) to plate 14 which seals the top of cylindrical housing 13. Switch 40 of the preferred embodiment is a reed switch that is sensitive to changes in the magnetic field.

When magnet 31 is in one position, for example that shown in FIG. 5, switch 40 is open blocking current flow through leads 42 and 43. The leads are attached by conventional fittings to switch housing 41 and electrically connected to switch 40. Note that the paddle is in the "flow" position in FIG. 5.

When flow stops and paddle 20 returns to its no-flow position (FIG. 3), magnet 31 rotates approximately 90°. This changes the magnetic field around switch 40 causing the switch to close. Current can then pass from lead 42 through lead 43 to an indicator such as a light, buzzer or bell to alert the operator that fluid flow has stopped.

The switch could be constructed to operate in an opposite manner with the indicator detecting opening of the switch rather than closing. Such a modification is within ordinary skill.

One feature that should be immediately noted is that the switch 40 and switch housing 41 are completely outside of tubular section 10 so that they do not contact flowing fluid. However, the signaling means in the form of magnet 31 is within tubular section 10, and there is no connection through tubular section 10 through the walls to move parts on the outside of the tubular section.

The plastic used in the present device does not interfere with the magnetic field so that the switch can detect position changes of magnet 31. The fasteners that are used, such as screws 15, are also nonmagnetic in the exemplary embodiment so that they will not interfere with the magnetic field created by magnet 31.

Magnet 31 is mounted in head 21, and the head is thick enough to accommodate the magnet. The bottom of the head is generally flush with the inner walls of tubular section 10 to eliminate turbulence. The magnet is sealed within the head to prevent fluid in the tubular section from contacting the magnet and causing corrosion to it. In the exemplary embodiment, the paddle is formed by injecting molding of plastic. The mold provides for a space to accommodate the magnet in the head and the magnet is press fit inside the space. Thereafter, the ends of the space are sealed with plugs or by material that will set once it is inserted into the ends. Alternatively, the magnet could be molded directly into the head, and the plastic material of the head would seal the magnet.

In order to ensure that the paddle rotates smoothly in the tubular section, pivot means on the head and on the axle are received within indentations on the tubular sections, and the paddle pivots at its connection between the pivot means and the indentations. In the exemplary embodiment, especially FIGS. 1, 3 and 6, the pivot means includes an extension 24 of axle 22, and an extension 25 on head 21. Tubular section 10 has an indentation 26 and plate 14 has another indentation 27 for receiving extensions 24 and 25. Indentations 26 and 27 become bearing surfaces for the extensions 24 and 25 and paddle means 20 rotates on these bearing surfaces.

Teflon bushings 35, 36 may be provided in one or both indentations 26, 27 to reduce friction on extensions 24, 25 to reduce the chance that the paddle could jam in the flow position.

Another possible cause of jamming occurs when fluid flowing at a high velocity past indentations 26 creates a vacuum therein. This has a tendency to pull extension 24 and paddle 20 against the bottom of bushing 35 such that even the relatively frictionless Teflon may not be able to prevent the paddle from jamming.

In order to solve this problem, relief means intersecting the indentation is provided for relieving the vacuum in the indentation caused by the flow of fluid over the indentation thereby allowing the paddle to pivot freely. Although the relief means could comprise one or more slots in the tubular section intersecting the indentation, the relief means of the preferred exemplary embodiment comprises an additional indentation 37 in the tubular section intersecting indentation 26 supporting pivot means 24. Through experimentation, it has been determined that if indentation 26 is 3/16 inches (0.476 cm), a ¼ inch (0.635 cm) relief indentation drilled with its center 5/16 inch (0.794 cm) from the center of bushing 37 relieves the vacuum.

One advantage of this drilled relief means is that elaborate machining is unnecessary. The correct location for relief indentation 37 can be set by a jig, and it can be drilled simultaneously with the drilling of indentation 26.

Preferably, the paddle should be limited to a 90° arc of rotation so that the biasing means does not unwind the paddle when flow stops. Therefore, guide means are provided on the head, and a pin on the tubular section is received in the guide means for limiting rotation of the paddle means. In the exemplary embodiment, the guide means comprises a cutout section 28 in head 21. A pin 16 is press fit through tubular section 10 to limit the rotation of the paddle.

Tolerances are somewhat important to the present invention. For example, if indentation 27 is not directly over indentation 26, there will be a tendency for the paddle to be at a slight angle which will create friction in the bearing surfaces. One of the ways of overcoming this problem is to have locating means for accurately locating the position of plate 14 on top of cylindrical housing 13. The locating means comprises a pair of nubs 17 which fit into depressions 18 prior to fastening plate 14 to the cylindrical housing 13 with fasteners 15. The nub-depression arrangement serves two purposes. First, it accurately positions the plate on the cylindrical housing. Moreover, it ensures that the plate and the switch fastened to the plate are not mounted at the wrong angle to the magnetic field and the fluid flow.

As discussed previously, the paddle is biased by biasing means to the FIG. 3 position. The biasing means comprises a spring mounted above the head whereby the head shields the spring from the fluid. As shown in FIG. 4 in the exemplary embodiment, biasing means comprises a coil spring 33. It is connected at one end to pin 21' on top of head 21. The other end of the spring is carried within slot 29 formed on plate 14. The material chosen for the spring must fulfill a number of criteria. It must have desirable spring characteristics, it must not corrode, and it should be nonmagnetic so that it does not affect the switch 40. Suitable materials will suggest themselves to those of ordinary skill.

Spring 33 may have bent portion 34 in slot 29 to relieve some of the shock on pin 21'.

With respect to corrosion of the spring, it should be noted that the cylindrical housing 13 generally surrounds head 21, the latter also having a circular cross section. If the diameter of the head is only slightly less than the inside diameter of the cylindrical housing, fluid may contact the spring, but it will not flow over the spring which will slow corrosion of the spring.

If the normal flow of fluid is insufficient to drive the paddle to the flow position, it may be necessary to effectively narrow the diameter of the tubular section around the paddle. Because the fluid velocity is inversely proportional to the cross-sectional area of the tubular section (assuming laminar flow) decreasing the effective area will increase fluid velocity.

One effective way of increasing fluid velocity is to mount baffle means across at least a portion of one side of the tubular section to direct fluid flow to the other side of the paddle means. In the exemplary embodiment, baffle means 50 (FIG. 3) comprises a baffle plate 51 mounted on shaft 52 which extends through tubular section 10. The opening through the tubular section 10 is sealed by O-ring 53, and the shaft is secured by nut 54 threaded on shaft 52.

In FIG. 3, baffle plate 51 is in its full blocking position for maximum increase in fluid velocity. For lesser increases, the baffle plate may be pivoted until at the horizontal position, only the edge of the plate would restrict flow but this restriction would be negligable. If desired, an indicator 55 may be fixed to the shaft with indicia printed on the outside of the flow detector so that the position of the baffle could be noted.

It will be understood that various modifications and changes may be made in the configuration described above which may come within the spirit of this invention, and all such changes and modifications coming within the scope of the appended claims are embraced thereby.

I claim:

1. In a device for detecting fluid flow comprising a tubular section through which fluid can flow, paddle means mounted in the tubular section for being moved to a flow position by fluid flowing through the tubular section, and biasing means biasing the paddle means to a no-flow position, the improvement comprising:

signaling means in the tubular section for signaling when the paddle means is in one of its positions, the paddle means having a head at the top of the paddle means and an axle depending from the head, the paddle means pivoting about the axle, the signaling means comprising a magnet mounted in the head of the paddle means such that the magnet pivots about the axis of the axle when the paddle means pivots, switch means mounted adjacent the tubular section for receiving a signal from the signaling means and for activating an indicator when it receives a signal for indicating the position of the paddle means, the switch means having means sensitive to the magnetic field whereby when the paddle means pivots about the axle between orientations, the magnetic field around the switch means changes causing the switch means to sense the change to activate the indicator.

2. In the device of claim 1, the improvement comprising the provision of magnet mounting means in the head for mounting the axis of the magnet from the poles perpendicular to the axle.

3. In the device of claim 15, the improvement further comprising:

baffle means across at least a portion of one side the tubular section to direct fluid flow to the other side of the tubular section whereby the speed of fluid passing the paddle means is increased.

4. In the device of claim 3, the improvement further comprising means on the baffle for adjusting the baffle to adjust the fluid flow past the paddle means.

5. In the device of claim 4, the improvement comprising the provision of:

pivot means on the head and on the axle and indentations in the inside of the tubular section receiving the pivot means whereby the paddle means pivots at its connection between the pivot means and the indentations.

6. In the device of claim 5, the improvement comprising:

relief means in the tubular section intersecting at least one of the indentations for relieving vacuum in the at least one indentation caused by the flow of water past the at least one indentation.

7. In the device of claim 6, the improvement comprising:

the relief means comprising an additional indentation in the tubular section intersecting the at least one indentation.

8. In the device of claim 7, the improvement comprising the provision of having the additional indentation downstream from the at least one indentation.

9. In the device of claim 1, the improvement comprising the provision of:

guide means on the head and a pin on the tubular section for being received in the guide means limiting rotation of the paddle means.

10. In the device of claim 1, the improvement comprising the provision of:

the biasing means comprising a spring mounted above the head whereby the head shields the spring from the flow of fluid.

11. In the device of claim 1, the improvement comprising the provision of:

the tubular section comprising a cylindrical housing perpendicular to the axis of the tubular section receiving the head, the head having a circular cross section of a diameter slightly less than the inside diameter of the cylindrical housing to prevent fluid flow to the top of the head.

12. In the device of claim 1, the improvement comprising the provision of:

the tubular section comprising a cylindrical housing perpendicular to the axis of the tubular section receiving the head, a plate mounted on the open end of the cylindrical housing to seal the cylindrical housing, a pair of depressions on the cylindrical housing and a pair of nubs on the plate, one nub being received in each depression, one depression and the nub received therein being spaced apart from the other depression and the nub received therein at an angle less than 180° about the cylindrical housing.

13. In a device for detecting fluid flow comprising a tubular section through which fluid can flow, paddle means mounted in the tubular section for being moved to a flow position by fluid flowing through the tubular section, and biasing means biasing the paddle means to a no-flow position, mounting means in the tubular section for mounting the paddle means, the improvement comprising the provision of:

the mounting means comprising an indentation at the bottom of the tubular section, and pivot means on the paddle means received within the indentation, relief means intersecting the indentation for relieving the vacuum in the indentation caused by the flow of fluid over the indentation thereby allowing the paddle to pivot freely.

14. In the device of claim 13, the improvement comprising:

the relief means comprising an additional indentation in the tubular section intersecting the indentation supporting the pivot means.

15. In the device of claim 14, the improvement comprising the provision of having the additional indentation downstream from the indentation supporting the pivot means.

16. In a device for detecting fluid flow comprising a tubular section through which fluid can flow, paddle means mounted in the tubular section for being moved to a flow position by fluid flowing through the tubular section, and biasing means biasing the paddle means to a no-flow position, mounting means in the tubular section for mounting the paddle means, the improvement comprising the provision of:

baffle means across at least a portion of one side the tubular section to direct fluid flow to the other side of the tubular section whereby the speed of fluid passing the paddle means is increased.

17. In the device of claim 16, the improvement further comprising means on the baffle for adjusting the baffle to adjust the fluid flow past the paddle means.

* * * * *

UNITED STATES PATENT AND TRADEMARK OFFICE

CERTIFICATE OF CORRECTION

PATENT NO. : 4,143,255

DATED : March 6, 1979

INVENTOR(S) : Jack Herscovitz

It is certified that error appears in the above-identified patent and that said Letters Patent are hereby corrected as shown below:

Column 2, line 25 change "cam" to --can--.

Column 2, line 53 change "on" to --to--.

In Claim 3, line 1 change "15" to --1--.

In Claim 5, line 1 change "4" to --1--.

Signed and Sealed this

*Thirty-first* Day of *July 1979*

[SEAL]

*Attest:*

*Attesting Officer*

LUTRELLE F. PARKER

*Acting Commissioner of Patents and Trademarks*